US008460480B2

(12) United States Patent
Janning

(10) Patent No.: US 8,460,480 B2
(45) Date of Patent: Jun. 11, 2013

(54) ABRASIVE WIRE CLEANING APPARATUS WITH STIRRING NOZZLES

(76) Inventor: Robert Janning, Cupertino, CA (US)

( * ) Notice: Subject to any disclaimer, the term of this patent is extended or adjusted under 35 U.S.C. 154(b) by 1744 days.

(21) Appl. No.: 11/704,446

(22) Filed: Feb. 9, 2007

(65) Prior Publication Data

US 2007/0186955 A1 Aug. 16, 2007

(51) Int. Cl.
*C23G 3/02* (2006.01)
*G03D 3/13* (2006.01)

(52) U.S. Cl.
USPC ..... 134/122 R; 134/184

(58) Field of Classification Search
USPC ..... 118/DIG. 18
See application file for complete search history.

(56) References Cited

U.S. PATENT DOCUMENTS 3,978,695 A * 9/1976 Hurzeler et al. ..... 68/20
5,182,694 A * 1/1993 Endo ..... 361/229

* cited by examiner

*Primary Examiner* — Michael Barr
*Assistant Examiner* — Jason Ko
(74) *Attorney, Agent, or Firm* — John Menear

(57) ABSTRACT

A stirring nozzle used in an apparatus for abrasive wire cleaning. The stirring nozzles can be used in series to create multiple cleaning steps wherein fresh cleaning compound contacts the wire to be cleaned. The cleaning apparatus moves both the wire and an abrasive cleaning compound through the interior of the stirring nozzles. At the exit end of each stirring nozzle, cleaning compound is moved outward from the wire path. At the inlet end of each stirring nozzle, cleaning compound is moved inward toward the wire path. The sequential in-and-out movement mixes the cleaning compound.

19 Claims, 7 Drawing Sheets

ABRASIVE WIRE CLEANING APPARATUS WITH STIRRING NOZZLES

CROSS-REFERENCE TO RELATED APPLICATIONS

This application claims priority to U.S. Provisional Application 60/773,949 entitled "Abrasive Wire Cleaning Apparatus with Stirring Nozzles" filed Feb. 16, 2006.

STATEMENT REGARDING FEDERALLY SPONSORED RESEARCH

Not Applicable

REFERENCE TO A MICROFICHE APPENDIX

Not Applicable

BACKGROUND OF THE INVENTION

1. Field of the Invention

This invention relates to wire cleaners, which are used to remove surface buildup from metallic wires. Metallic wires include single metals and alloys. For example, nickel/titanium wires may be cleaned with this instant invention. This invention is particularly applicable where a viscous cleaning compound under pressure is used.

2. Description of Related Art

Wire cleaning methods may be chemically based, mechanical (abrasive), or a combination of both. Chemical cleaning methods provide good cleaning uniformity. However, chemical cleaning methods require environmental and safety controls. Abrasive systems usually do not. Hence, abrasive systems are often preferred for simplicity of installation and use.

One type of abrasive cleaning method is sand blasting. Sand blasting is effective and aggressive, but surface uniformity of the cleaned wire is marginal.

Another abrasive method is buffing with fine grit wheels. With wheel buffing, wire surface quality is better than sand blasting. But under a microscope a non-uniform herringbone scratch pattern is apparent.

An abrasive nozzle method forces both a viscous cleaning compound and the wire into a prior art nozzle. The cleaning compound enters through the wide end of a cone, which is integrated into the entry end of the nozzle. The cleaning compound exits through an opening in the exit end of the nozzle. The wire to be cleaned travels along the axis of the nozzle. Most of the cleaning occurs where the wire passes through the apex of the cone. High pressure creates close surface contact between the wire and the cleaning compound. Furthermore, the relative velocity between the wire and the cleaning compound is enhanced by turbulent flow of the cleaning compound.

Cleaning results for the abrasive cone method have been satisfactory. But the abrasive cone method, as currently practiced, is not optimal.

In particular, the use of multiple nozzles to create multiple cleaning steps integrated into one pass through the cleaning apparatus has not proven useful. Wire surface quality from experiments with multiple nozzles was roughly the same as the surface quality using a single nozzle.

The reason is the shape of the nozzle. The cleaning compound, which is in close contact with the wire surface, does not change as the wire moves from one nozzle to the next. That is, the prior art nozzle shape does not mix the cleaning compound.

A new nozzle design is needed.

BRIEF SUMMARY OF THE INVENTION

The core of present invention is a stirring nozzle for use in an abrasive wire cleaning apparatus.

The invented stirring nozzle receives cleaning compound through the open end of a cone, which is integrated into the entrance end of the nozzle. This is similar to the prior art nozzle.

The wire to be cleaned travels along the axis of the nozzle. And most of the cleaning occurs where the wire passes through the apex of the cone.

The difference between the prior art nozzle and the stirring nozzle is a mixing capability. After passing the apex of the cone, some of the cleaning compound is directed outward (away from the wire) through a plurality of stirring holes. This separates used cleaning compound from the wire surface. Equally important, it allows fresh cleaning compound to contact the wire at the following stirring nozzle.

Each stirring nozzle is substantially the same. The entry end of each nozzle is the wide opening of a cone. As cleaning compound travels through the conical section of the nozzle, it is guided closer toward the wire since the cross section of the cone decreases as the apex of the cone is approached.

Fresh cleaning compound is forced into close wire contact as the wire passes through the apex of the cone. Then, after, passing the apex of the cone, some of the cleaning compound is again directed outward through a plurality of stirring holes.

The same sequence repeats at each nozzle. Cleaning compound is forced inward toward the wire at the entry end of the nozzle. Then it is forced outward at the exit end of the nozzle.

This mixing action of multiple stirring nozzles conforms to general cleaning principles. That is, the wire repeatedly contacts fresh cleaning compound.

Several stirring nozzles are integrated into a chamber which is part of a cleaning apparatus. The chamber must be able to hold operating pressures that may exceed 5000 psi. In one variation, the cleaning chamber has seals that are designed for intentional exit flow at normal operating pressures. Cleaning compound that exits through seals may be re-pressurized and re-used.

Both wire an cleaning compound are passed through the cleaning apparatus. Cleaning compound is supplied through a pump. The wire originates from a feeder on one side of the apparatus, and is collected onto a collector on the opposite side of the apparatus. Frequently, both the feeder and collector are coiling mechanisms.

In one design, the wire and cleaning compound move in opposite directions. This assures the cleanest wire moves toward the cleanest cleaning compound. Contaminant redeposition onto the wire surface is minimized.

Objects of this invention include:

(a) provide a stirring nozzle that forces the cleaning compound toward the wire in an entry end, and separates the cleaning compound from the wire in an exit end;

(b) use multiple stirring nozzles in series to provide a mixing action for the cleaning compound, where the mixing action is a periodic inward and outward movement;

(c) integrate the nozzles into a pressurized chamber that is compatible with the cleaning compound pressure;

(d) where appropriate, place seals in the pressurized chamber through which cleaning compound can exit;

(e) where appropriate, recirculate the cleaning compound.

DETAILED DESCRIPTION OF THE INVENTION

Figure 1:
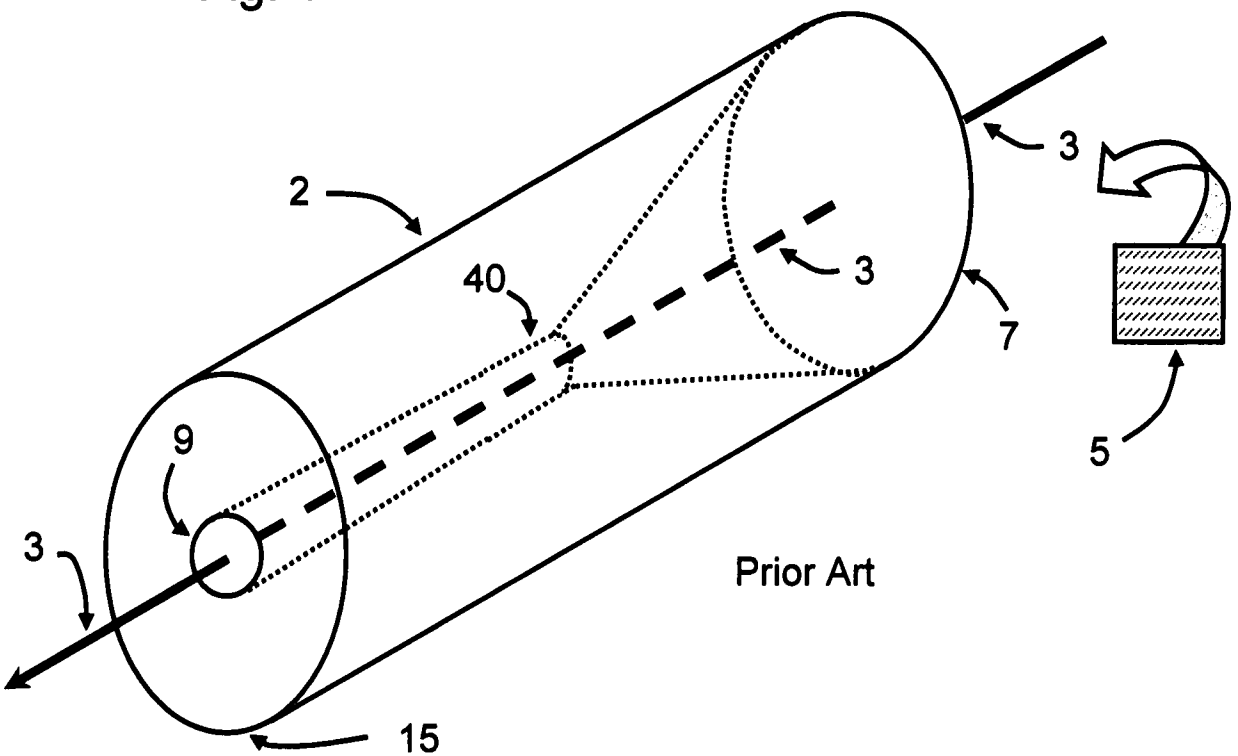
FIG. 1 is a pictorial diagram showing a prior art cleaning nozzle.
Figure 2:
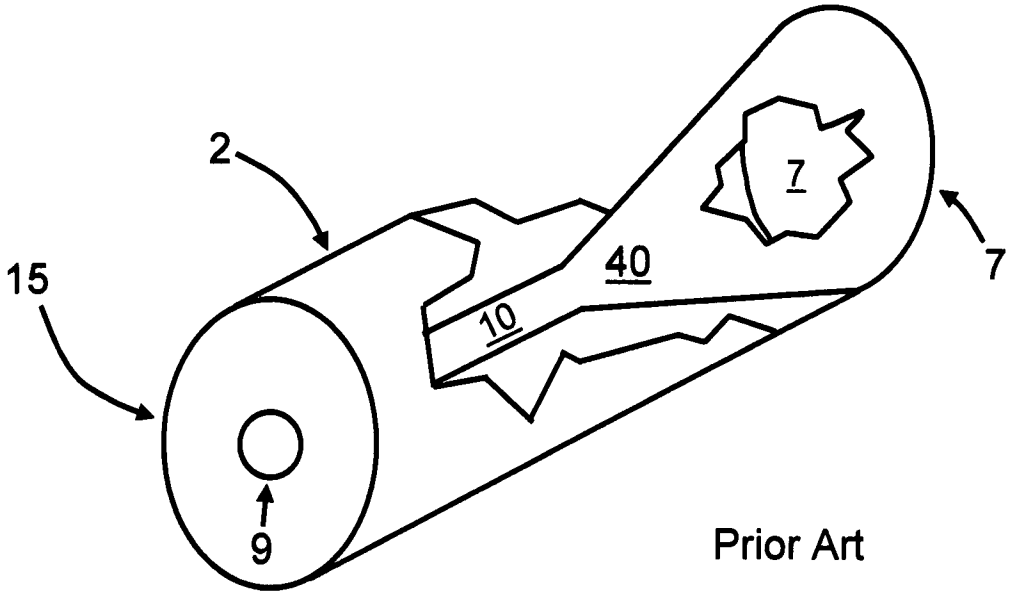
Prior Art Fig. 2
FIG. 2 is a pictorial diagram of a prior art cleaning nozzle with cut-away views of the entry end.

FIG. 1 and FIG. 2 show a prior art cleaning nozzle 2 that is used in a wire 3 cleaning apparatus. The wire 3 that is being cleaned passes through the prior art nozzle 2. Inside the prior art nozzle 2, the wire contacts an abrasive cleaning compound 5. The entry end 7 of the prior art cleaning nozzle 2 is has a conical shape.

Cleaning compound 5 enters through the entry end 7 and moves toward the apex 40 of the conical shape. At the apex 40, the wire 3 and the cleaning compound 5 are pressed tightly together by system pressure. Movement of the wire 3 and abrasive cleaning compound 5, relative to each other, produces the desired cleaning.

The cleaning compound 5 moves through the apex 40 and continues through the wire path 10 and out through the wire exit hole 9. The wire 3 may move through the prior art nozzle 2 in the same direction as the wire 3 or in the opposite direction from the wire 3.

Figure 3:
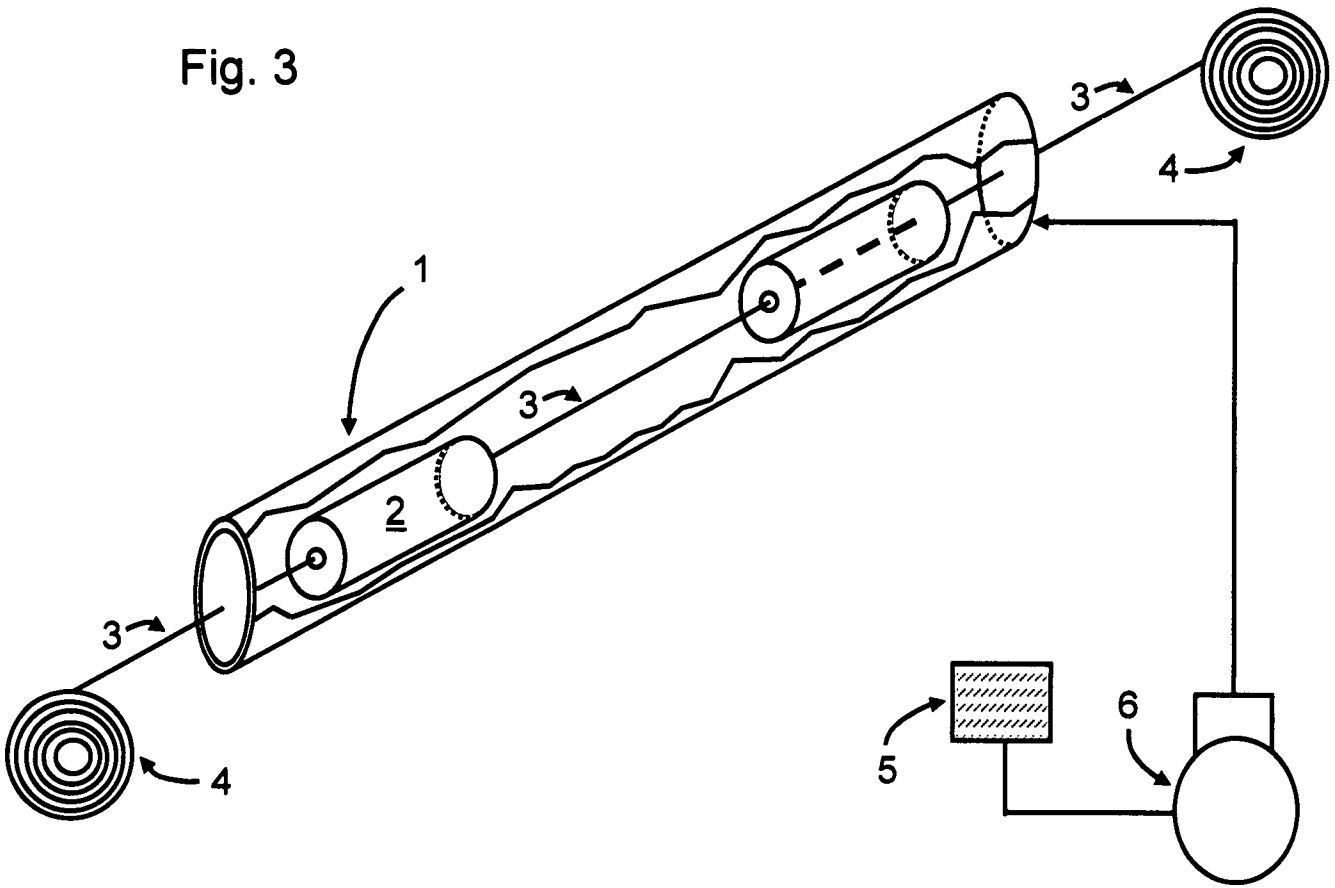
FIG. 3 shows two prior art cleaning nozzles integrated into a cleaning apparatus.

FIG. 3 shows one or more prior art nozzles 2 positioned inside a cleaning chamber 1. The wire 3 passes through all prior art cleaning nozzles 2 that are within the cleaning chamber 1. Wire coils 4 are located at both ends of the cleaning chamber 1. The wire 3 moves from one wire coil 4 to the other.

Cleaning compound 5 is pressurized by a pump 6 and fed into the cleaning chamber 1 to the entry end 7 of the prior art nozzle 2.

A cleaning chamber 1 that utilizes prior art nozzles 2 functions well. Cleaning is partially effective and the surface uniformity of the wire 3 is good. But experiments show that using multiple prior art nozzles 2 is not significantly better than using only one prior art nozzle 2.

To achieve the cleaning potential from multiple cleaning nozzles, mixing of the cleaning compound 5 is necessary. Mixing is achieved with the stirring nozzle 12.

Figure 4:
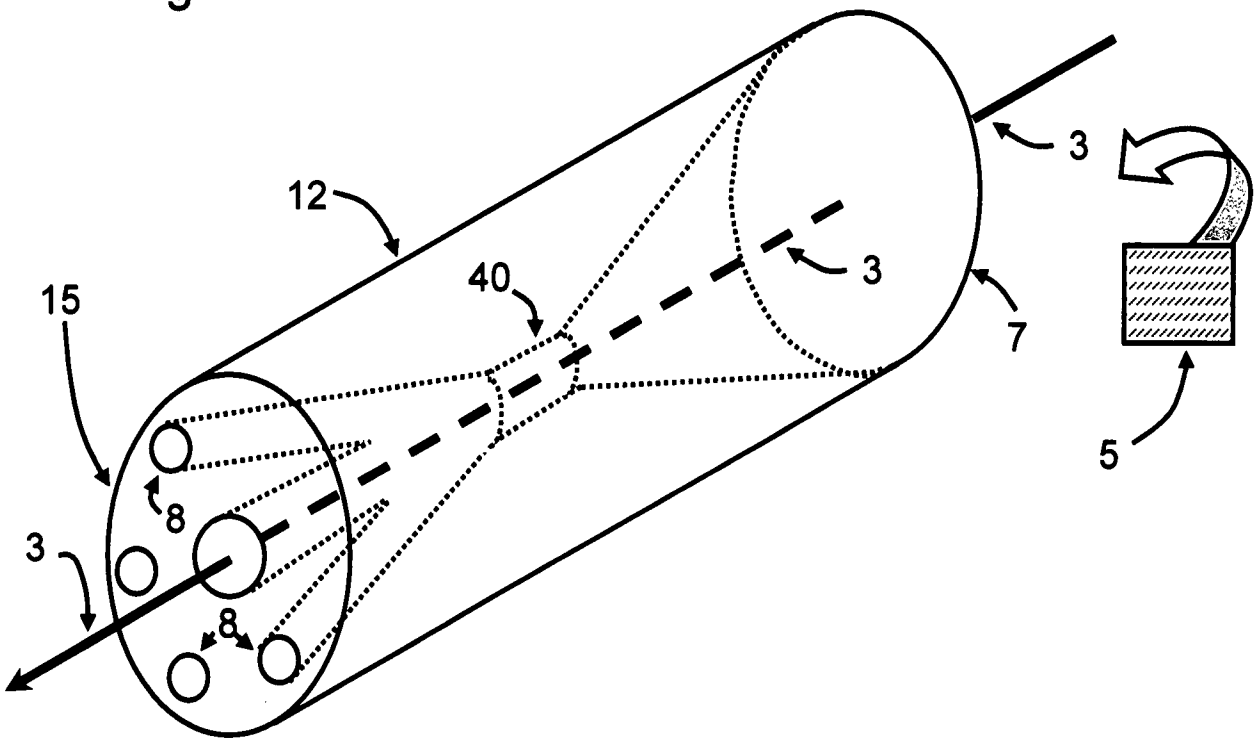
FIG. 4 is a pictorial diagram showing an invented stirring nozzle.
Figure 5:
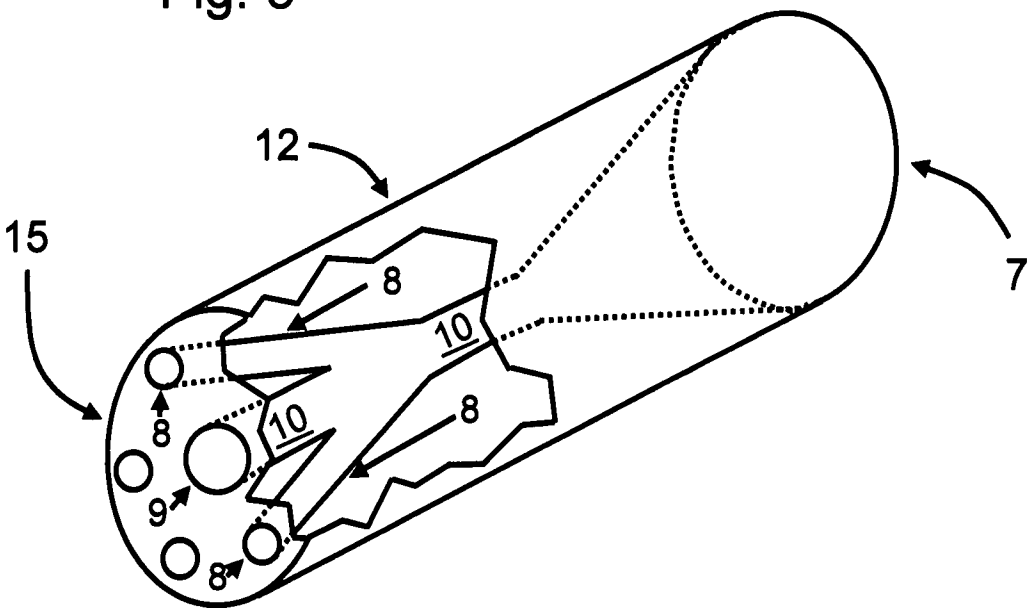
FIG. 5 is a pictorial diagram showing a cut-away of the invented stirring nozzle.

FIG. 4 and FIG. 5 show the invented stirring nozzle 12. The entry end 7 and the apex 40 are unchanged from the prior art cleaning nozzles 2. But the exit end 15 is different.

The stirring nozzle 12 has one or more stirring holes 8 that originate from the exit end 15 of the stirring nozzle 12 and connect to the wire path 10.

The stirring holes 8 provide a route for cleaning compound 5 to move outward, away from the wire path 10. The wire 3 follows the wire path 10 and exits the stirring nozzle 12 through the wire exit hole 9.

Figure 6:
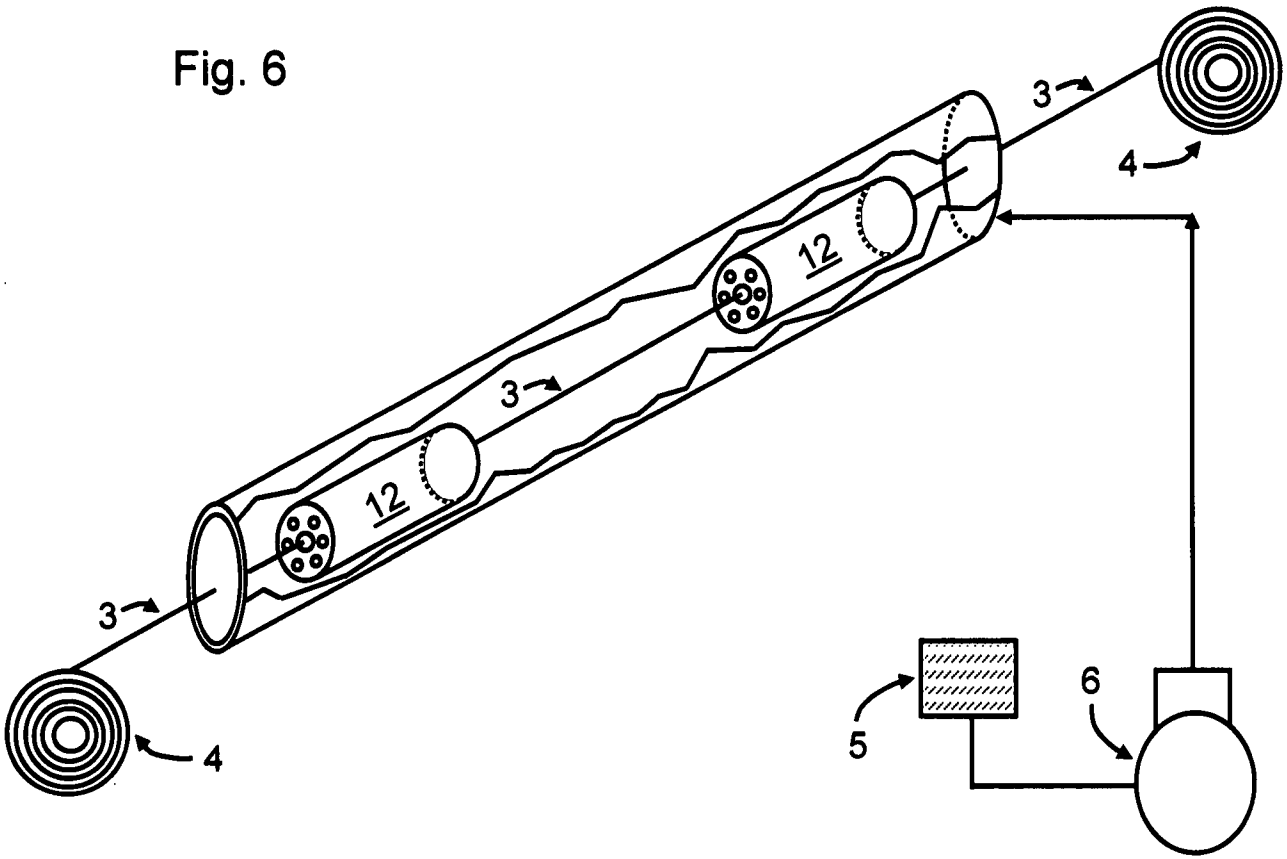
FIG. 6 shows two invented stirring nozzles integrated into a cleaning apparatus.

FIG. 6 shows two stirring nozzles 12 integrated into the cleaning chamber 1. When more stirring nozzles 12 are incorporated, additional cleaning and mixing steps result.

The entry end 7 of each stirring nozzle 12 receives mixed cleaning compound 5. Freshly mixed cleaning compound 5 is brought into contact with the wire 3 at the apex 40 of each stirring nozzle 12.

Multiple stirring nozzles 12 are more effective than a single stirring nozzle 12.

Because multiple cleaning equilibriums are achieved with multiple stirring nozzles 12, the value of moving the wire 3 in the opposite direction to the cleaning compound 5 is particularly effective. For example, assume that the partition ratio were 1:1 between buildup on the wire 3 and buildup in the cleaning compound 5 that is close to the wire. Then the first stirring nozzle 12 would remove 50% of the buildup on the wire 3. The second stirring nozzle 12 would remove 50% of the remaining 50% (75% for both). The third stirring nozzle 12 would remove 50% of the remaining 25% (87.5% for both).

With opposing flow directions, contamination is always moves toward the dirtiest portion of the wire 3. And fresh cleaning compound 5 is always contacts the cleanest portion of the wire 3. In one preferred embodiment of a cleaning apparatus, cleaning compound 5 enters the cleaning chamber 1 in the middle. Hence, the wire 3 flows moves in the same direction as the cleaning compound 5 in one section of the cleaning apparatus, and opposite in a second section.

A useful modification of the cleaning chamber 1 is the addition of exit seals 14. Exit seals 14 purposely allow a small amount of cleaning compound 5 to exit said cleaning chamber while maintaining an operating pressure of 5000 PSI. Without the exit seals 14, cleaning compound 5 could create unnecessary wire scratching due to contaminant buildup. Without any seals, operating pressure would fall below 5000 PSI.

In combination with the exit seals 14, recirculation of cleaning compound 5 is appropriate. The alternative is to dispose of the used cleaning compound 5 after only one pass through the cleaning chamber 1.

Figure 7:
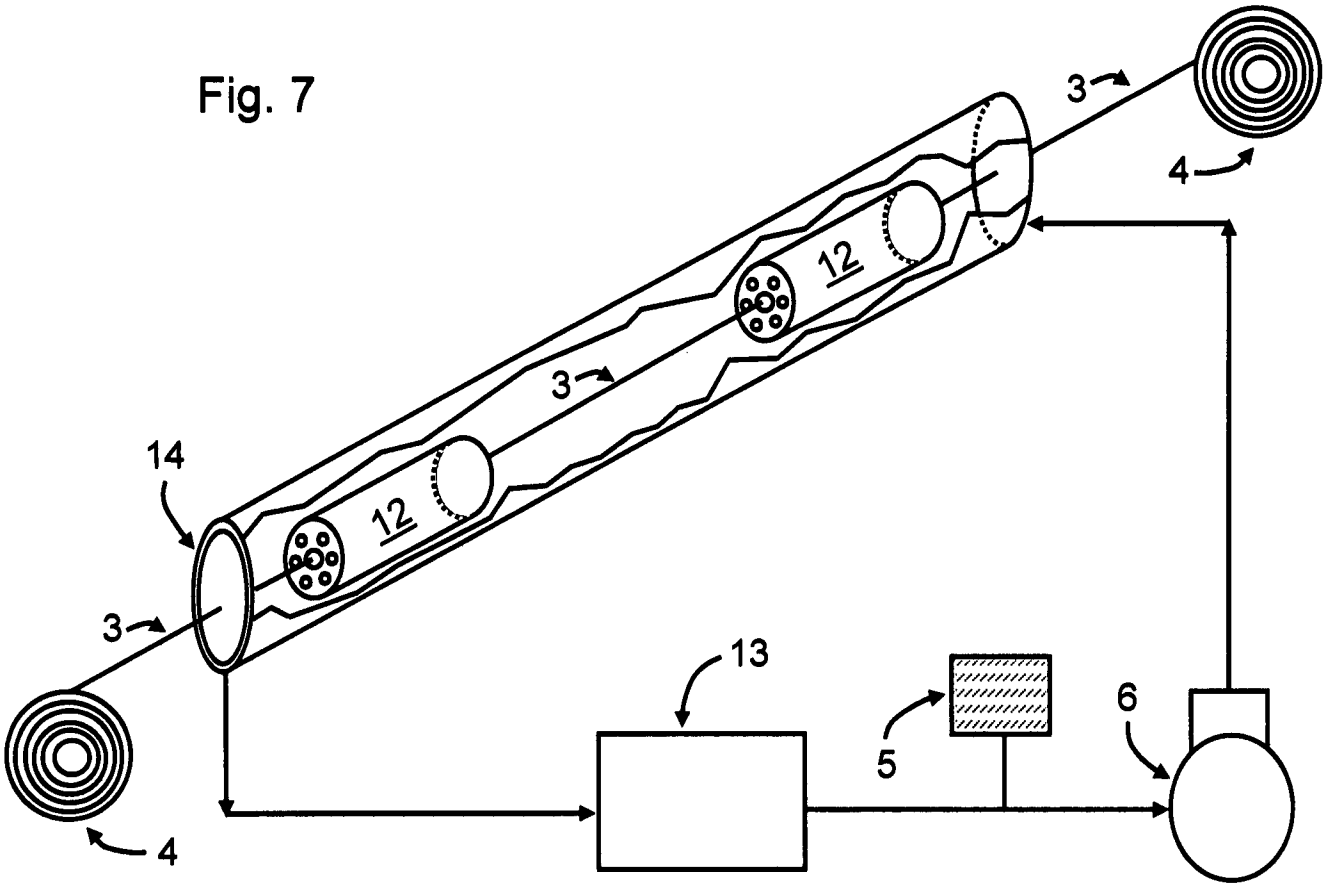
FIG. 7 shows two invented stirring nozzles integrated into a cleaning apparatus which further contains a recirculation loop for cleaning compound.

FIG. 7 diagrams the use of a recycle chamber 13 that feeds exited cleaning compound 5 to the inlet of the pump 6.

Alternately, the pump 6 may be replaced with a piston drive that can achieve operating pressure.

The invention claimed is:

1. An abrasive wire cleaning apparatus for cleaning a wire comprising:

a cleaning chamber;

one or more stirring nozzles serially disposed within said cleaning chamber;

a wire feeder;

a wire collector;

a cleaning compound which moves through said one or more stirring nozzles, is abrasive, enters each said one or more stirring nozzles through an entry end, exits each said one or more stirring nozzles through an exit end, and fills said one or more stirring nozzles during operation; and a pump capable of producing 5000 PSI to move said cleaning compound through said one or more stirring nozzles.

2. The apparatus of claim 1 wherein said one or more stirring nozzles comprise:

a substantially conical entry end with an opening at the apex;

a wire path that includes said apex and ends at a wire exit hole in an exit end of said one or more stirring nozzles; and one or a plurality of stirring holes which connect said wire path to said exit end of said one or more stirring nozzles.

3. The apparatus of claim 1 wherein said wire feeder utilizes a coil.

4. The apparatus of claim 1 wherein said wire collector utilizes a coil.

5. The apparatus of claim 1 wherein said cleaning compound contains a viscous polymeric base.

6. The apparatus of claim 1 wherein said cleaning compound contains silicon carbide particles.

7. The apparatus of claim 1 wherein said cleaning compound contains cutting oil.

8. The apparatus of claim 1 wherein said cleaning chamber can withstand pressure greater than 5000 psi.

9. The apparatus of claim 1 wherein all or part of said wire moves in the opposite direction to the cleaning compound.

10. The apparatus of claim 1 wherein said cleaning chamber contains exit seals which purposely allow said cleaning compound to exit said cleaning chamber.

11. The apparatus of claim 1 wherein a recirculating loop returns cycled said cleaning compound to said cleaning chamber.

12. The apparatus of claim 11 wherein said recirculating loop includes a pump.

13. The apparatus of claim 12 wherein said a pump is a piston pump.

14. The apparatus of claim 12 wherein said recirculating loop includes a valve.

15. The apparatus of claim 1 wherein all or part of said wire moves in the same direction as said cleaning compound.

16. A method for cleaning the surface of wire comprising:
moving said wire through one or more stirring nozzles;
moving an abrasive cleaning compound through said stirring nozzles; and
contacting said wire with said cleaning compound inside said stirring nozzles,
wherein the method is applied to an abrasive wire cleaning apparatus comprising:
a cleaning chamber;
one or more stirring nozzles serially disposed within said cleaning chamber;
a wire feeder;
a wire collector;
a cleaning compound which
moves though said one or more stirring nozzles,
is abrasive,
enters each said one or more stirring nozzles through an entry end,
exits each said one or more stirring nozzles through an exit end, and
fills said one or more stirring nozzles during operation; and
a pump capable of producing 5000 PSI to move said cleaning compound through said one or more stirring nozzles.

17. Claim 16 where an entry end of said stirring nozzles moves said cleaning compound inward toward the wire.

18. Claim 16 where an exit end of said stirring nozzles moves said cleaning compound outward from said wire.

19. Claim 16 where said cleaning compound is mixed by inward and outward movement.

* * * * *